US007488132B2

(12) United States Patent
Shrader

(10) Patent No.: US 7,488,132 B2
(45) Date of Patent: Feb. 10, 2009

(54) PORTABLE MARKING DEVICE FOR USE WITH TRANSIENT DOCUMENT MEDIA

(75) Inventor: Eric J. Shrader, Belmont, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 11/314,891

(22) Filed: Dec. 21, 2005

(65) Prior Publication Data

US 2007/0140775 A1 Jun. 21, 2007

(51) Int. Cl.
*B43K 29/00* (2006.01)

(52) U.S. Cl. ..... 401/195

(58) Field of Classification Search ..... 401/52, 401/195

See application file for complete search history.

(56) References Cited

U.S. PATENT DOCUMENTS 6,164,856 A * 12/2000 Lo ..... 401/52
6,860,616 B2 3/2005 Yu et al.
7,160,045 B2 * 1/2007 Oas ..... 401/195
7,300,727 B2 * 11/2007 Kazmaier et al. ..... 430/19
2005/0244742 A1 11/2005 Iftime et al.
2005/0244743 A1 11/2005 Iftime et al.
2005/0244744 A1 11/2005 Kazmaier et al.

* cited by examiner

*Primary Examiner*—Huyen Le
(74) *Attorney, Agent, or Firm*—Fay Sharpe LLP

(57) ABSTRACT

The presently described embodiments take an exemplary form of a pen with an ink formulated from dyes that are compatible with transient document media systems. In one form, an internal ultraviolet source that illuminates the ink that is to be written is provided to the pen. This transforms the ink into a dark state. Once written, the lines can be seen like a conventional ink. When heat used to erase the underlining sheet is applied, the annotations made by the subject device will be erased as well.

18 Claims, 3 Drawing Sheets

PORTABLE MARKING DEVICE FOR USE WITH TRANSIENT DOCUMENT MEDIA

BACKGROUND

The presently described embodiments relate to a portable marking device for use with transient document media. It finds particular application in annotating such transient document media, and will be described with particular reference thereto. However, it is to be appreciated that the present exemplary embodiments are also amenable to other like applications.

By way of background, many paper documents are-discarded after being read. Although paper is inexpensive, the quantity of discarded paper documents is enormous and the disposal of these discarded paper products raises significant cost and environmental issues.

To address this problem, transient document media systems have been developed. Transient document media is a media designed to replace conventional paper for some applications. It is typically marked upon using ultraviolet (UV) light and typically erased with heat. It is designed so that the media, or paper, may be reused with different images rendered thereon so one can replace paper printing in some applications.

In this regard, transient document media involves providing a reimagable medium comprised of a substrate and a photochromic material, wherein the medium is capable of exhibiting a color contrast and an absence of the color contrast. The reimagable medium is exposed to an imaging light corresponding to a predetermined image to result in an exposed region and a non-exposed region. The color contrast is present between the exposed region and the non-exposed region to allow a temporary image corresponding to the predetermined image to be visible to the naked eye.

In one form, this type of marking on paper can be accomplished by using paper having a particular dye coated thereon. Exposed regions of the dyed paper may then be excited by a radiation source such as ultraviolet light.

To erase the temporary image, transient document media systems subject a temporary image to an indoor ambient condition for a time period. This serves to change the color contrast to erase the temporary image without using an image erasure device. Thus, the temporary image is visible for a time sufficient for the observer to view the temporary image. However, the visible time is limited to permit the optional feature of repeating the procedure as described. So, the temporary image information and temporary image erasure may be performed a number of times on the same media. In some forms, the reimagable medium may be considered self-erasing.

Transient document systems of this type are described in U.S. Publication No. US 2005/0244742 A1, entitled "Reimagable Medium with Light Absorbing Material," filed Apr. 29, 2004, U.S. Publication No. US 2005/0244743 A1, entitled "Reimagable Medium," filed Apr. 29, 2004, and U.S. Publication No. US 2005/0244744 A1, entitled "Method for Forming Temporary Image," filed Apr. 29, 2004, all of which are incorporated herein by this reference.

In some applications, users may wish to annotate media having temporary images formed thereon. However, if traditional marking pens are used on the media, a difficulty may arise. That is, because the transient document media is reusable, any annotations written by the user on the media using a conventional marking pen will be seen by the next user. As such, transient document media systems could be improved.

A variety of light and/or marking pens are known. At least some of these known pens have been used for preventing fraud and the like, or for writing in invisible ink. For example, U.S. Pat. No. 6,860,616 discloses a pen that writes with fluorescent ink. An ultraviolet light emitting diode (LED) is provided to the pen to illuminate the ink as it is written. It should be noted that this pen, however, does not excite the ink prior to writing and may well be limited to fluorescent inks.

BRIEF DESCRIPTION

In accordance with one aspect of the present exemplary embodiment, a marking instrument comprises a elongated housing having a marking tip disposed at a first end, a reservoir defined within the housing, an ultraviolet radiation source supported in the reservoir and proximate to the first end of the housing, and, a power source positioned within the housing and operative to provide power to the ultraviolet radiation source.

In accordance with another aspect of the present exemplary embodiment, the marking tip comprises a roller ball.

In accordance with another aspect of the present exemplary embodiment, the reservoir is proximate the first end.

In accordance with another aspect of the present exemplary embodiment, the ultraviolet radiation source is an ultraviolet light emitting diode.

In accordance with another aspect of the present exemplary embodiment, the ultraviolet radiation source comprises a lens operative to focus ultraviolet radiation on the marking tip.

In accordance with another aspect of the present exemplary embodiment, the marking instrument comprises marking fluid disposed within the reservoir.

In accordance with another aspect of the present exemplary embodiment, the marking fluid comprises ink.

In accordance with another aspect of the present exemplary embodiment, the ink comprises a spiropyran substance.

In accordance with another aspect of the present exemplary embodiment, the marking fluid comprises active components that are excitable upon exposure to ultraviolet radiation emitted by the ultraviolet radiation source.

In accordance with another aspect of the present exemplary embodiment, the power source is a battery.

In accordance with another aspect of the present exemplary embodiment, the marking instrument comprises a switching element operative to selectively control emission of ultraviolet radiation from the ultraviolet radiation source.

In accordance with another aspect of the present exemplary embodiment, a marking instrument comprises a housing having a marking tip disposed at a first end, a reservoir defined within the housing, the reservoir having marking fluid disposed therein, the marking fluid comprising active components that are excitable upon exposure to selected wavelengths of radiation, a radiation source operative to selectively emit radiation and to focus the emitted radiation through the marking fluid near the marking tip, and, a power source operative to selectively provide power to the radiation source.

In accordance with another aspect of the present exemplary embodiment, the marking tip comprises a roller ball.

In accordance with another aspect of the present exemplary embodiment, the radiation source is a light emitting diode.

In accordance with another aspect of the present exemplary embodiment, the marking fluid comprises ink.

In accordance with another aspect of the present exemplary embodiment, the ink comprises a spiropyran substance.

In accordance with another aspect of the present exemplary embodiment, the marking instrument comprises a switching element operative to control the selective emission of radiation from the radiation source.

In accordance with another aspect of the present exemplary embodiment, a method for using a marking instrument in a transient document media system, the marking instrument including a reservoir having a marking fluid exposed therein and a marking tip disposed at an end thereof, a radiation source being positioned to emit radiation into the reservoir, comprises providing power to the radiation source, exciting the marking fluid in the reservoir by the radiation source such that the marking fluid becomes active in the visible light range, and, manipulating a marking instrument such that the excited marking fluid exits the reservoir through the marking tip.

In accordance with another aspect of the present exemplary embodiment, the radiation source is an ultraviolet radiation source.

In accordance with another aspect of the present exemplary embodiment, the radiation source is housed within the reservoir.

DETAILED DESCRIPTION

Figure 1:
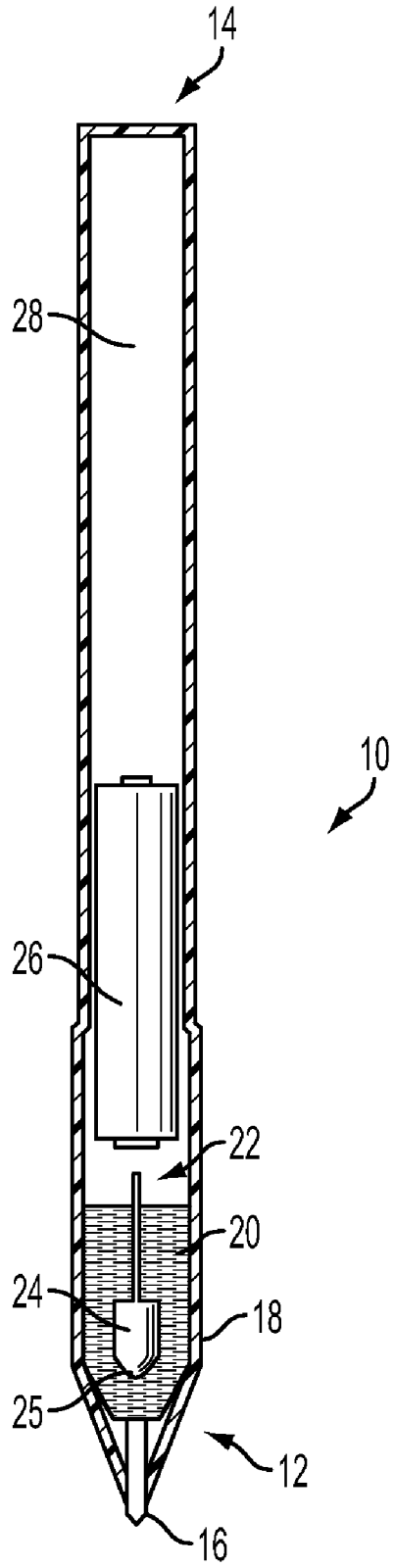
FIG. 1 is a representative illustration of a marking device according to the presently described embodiments.

The presently described embodiments are useful in connection with transient document media systems and relate to a marking device having a resident marking fluid, e.g. ink formulated from dyes that are compatible with transient document media systems. In one form to be described in greater detail below; the marking device makes use of a radiation source that illuminates the fluid that is to be emitted from the marking device to form desired annotations. This illumination or excitation transforms the fluid, in one form, into a dark state. Once emitted or written, any lines drawn can be seen by observers, much like a conventional ink. However, when heat is applied to erase the markings on the media, the annotations will be erased along with the underlying image.

More particularly, in one form of the presently described embodiments, a pen is implemented having, for example, a spiropyran-based ink housed therein. A radiation source takes the form of an ultraviolet (UV) light emitting diode (LED) and is positioned to illuminate the ink while it is in a reservoir of the pen. In one form, the ultraviolet (UV) light emitting diode (LED) is positioned in close proximity to a location where the ink is emitted from the pen. For safety reasons, in one form, the ultraviolet (UV) light emitting diode (LED) is likewise enclosed within the reservoir of the pen, with the ink. Moreover, in at least one form, the light emitted does not escape the reservoir. The light emitting diode (LED) is activated for only such time as is required to energize the ink and is then turned off. Of course, the light emitting diode (LED) could alternatively be positioned where the ultraviolet radiation can be focused on the ink, not necessarily within the reservoir. Even in these cases, the system can be designed so that no light escapes the housing in which it illuminates the ink.

The ultraviolet (UV) light emitting diode (LED) can be switched on or activated by the user manually by removing a cap or extending the pen tip, much like a conventional pen. The ink is nominally colorless in the non-excited state and becomes colored, or more visible or active in the visible light range, when it is illuminated or excited by ultraviolet (UV) light from the ultraviolet (UV) light emitting diode (LED).

Once written, the annotations can be seen by the user for a time period (e.g. four hours) until the paper is reused and the annotation image is erased along with the main image. It should be understood that there may be a very dim gloss change where the annotation existed. However, if a matte finish was originally used, it will not likely be noticeable for future users of the sheet, as the annotation ink may absorb into the matte surface.

An advantage of the system is that the pen can be used with a transient document media system that allows a user to handwrite annotations on the paper without destroying the reusable property of the media. Notably, the presently described embodiments relate to a marking device that changes the properties of the ink prior to writing. That is, the ink is placed in an excited, readable state prior to exiting the pen.

With reference to FIG. 1, a marking device 10 is illustrated. In accord with the presently described embodiments, the marking device 10 is, in at least one form, an elongated housing of suitable material that takes the form of a pen and/or is sized so as to be useful as a hand-held writing instrument for manipulation by the human hand. The marking device 10 includes a first end 12 and a second end 14. At the first end 12, a marking tip 16 is provided as an egress for marking material or fluid 20 that is housed within a reservoir 18. In one form, a radiation source is provided within the reservoir 18. For example, a radiation source may include an assembly 22 having an ultraviolet light emitting diode (LED) 24 provided to the assembly. The radiation source assembly 22 has power selectively provided to it by a power source 26. In one form, the power source is a battery. It should be understood that the radiation source and power source may take a variety of forms to achieve the presently described embodiments. In one form, the radiation source and the power source are sized so as to fit within a marking device sized for hand manipulation by a user.

At the second end 14, a switching element is provided. A switching element 28 is merely representatively shown. As noted above, however, the switching element may take a variety of forms that are well known in the pen and ink industry. For example, the switching element will provide a user with the ability to manually activate the radiation source by twisting the pen, removing a cap, extending the pen tip, pressing a button, . . . etc.

It should be appreciated that, as shown, the ultraviolet (UV) light emitting diode (LED) is immersed within the ink of the reservoir 18. In addition, the light emitting diode (LED) 24 may be provided with an appropriate lens configuration, such as that shown at 25, so that the radiation from the light emitting diode (LED) 24 can be focused on the marking fluid 20. As noted above, in at least one form, the light emitting diode (LED) 24 is positioned (and the entire assembly 10 is designed) so that the energy emitted by the light emitting diode (LED) 24 does not escape the reservoir 18 and/or the housing of the device 10. This, of course, has safety advantages.

The marking tip 16 may take a variety of forms. In one form, the marking tip 16 includes a roller ball, or ballpoint, configuration. However, a felt tip may also be provided. It should be understood that a felt tip pen may not be as practical because ink may be retained within the felt. As such, exciting the ink may be slightly more difficult in these situations.

With respect to the marking fluid composition, a variety of formulations would be suitable. In at least one form, the marking fluid comprises active components that are excitable upon exposure to selected wavelengths of radiation, such as ultraviolet radiation. The excitation of the active components will, in one form, result in the marking fluid becoming active in the visible light range. For example, a dye—such as a dye that is compatible with a dye used in the transient document system as described, for example, in U.S. Publication No. US 2005/0244742 A1, entitled "Reimagable Medium with Light Absorbing Material," filed Apr. 29, 2004, U.S. Publication No. US 2005/0244743 A1, entitled "Reimagable Medium," filed Apr. 29, 2004, and U.S. Publication No. US 2005/0244744 A1, entitled "Method for Forming Temporary Image," filed Apr. 29, 2004, all of which are incorporated herein by this reference—could be used alone or along with a binder to result in ink to be used with the pen. Any appropriate binder could be used. Any ink or other type of fluid that would allow for the reversible process contemplated herein would be suitable. For example, such ink formulated for ink-jet type printers may be adapted for use in the presently described embodiments. In this regard, an ink that can be written in an excited state—such that the excited state will be maintained for a suitable period of time to allow for reading of the material, and then allow for erasure—would be suitable. It should also be understood that the material that has been referred to as marking fluid may take a variety of forms, including that of a gel or powder.

Figure 2:
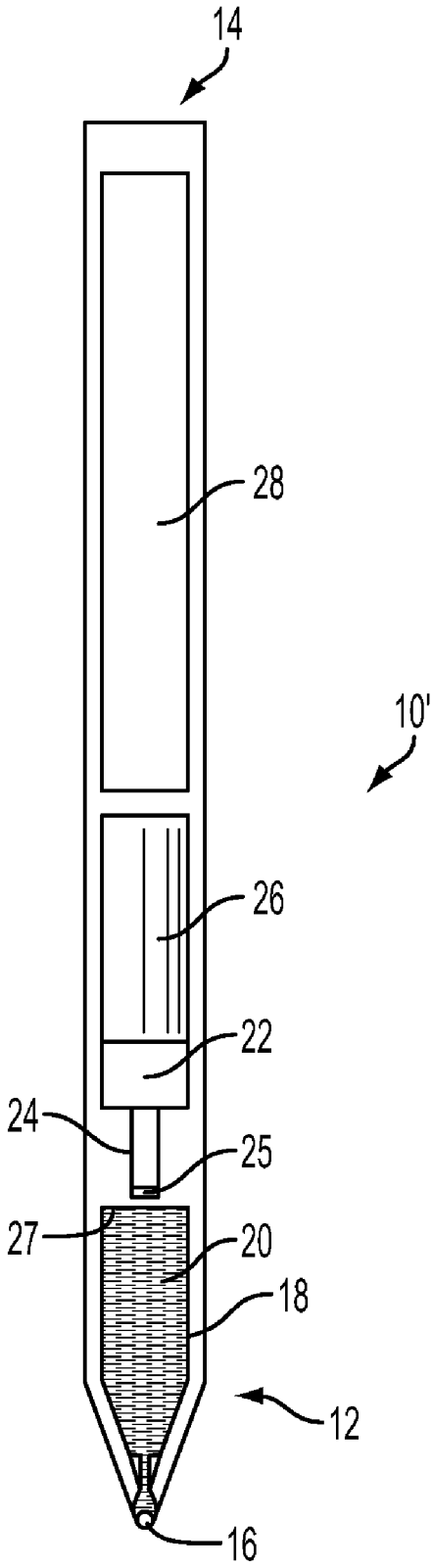
FIG. 2 is a representative illustration of a marking device according to the presently described embodiments; and, FIG. 3 is a flow chart illustrating a method according to the presently described embodiments.

It should be appreciated that the radiation source does not necessarily need to be positioned within the reservoir. The radiation source simply needs to be optically coupled to the ink. With reference now to FIG. 2, a marking device 10' is shown. The components of the device 10' are substantially the same as components of device 10; however, the configuration of the components of device 10' is different. For example, no part of the radiation source, e.g. the light emitting diode 24 (along with lens configuration 25), is housed within the ink reservoir 18, as in FIG. 1. In the device 10' of FIG. 2, like the assembly 22 and power source 26, the ultraviolet (UV) light emitting diode 24 is positioned adjacent the reservoir 18. It should be appreciated, however, that the radiation source, e.g. the ultraviolet (UV) light emitting diode (LED) is, in at least one form, optically coupled to the reservoir so as to focus radiation on the fluid within the reservoir to excite the fluid, as describe above. Along these lines, the reservoir 18 may be provided with a transparent wall or lens configuration 27 to allow for a focusing of light into the reservoir to illuminate the marking fluid. As above, in at least one form, the emitted radiation or light does not escape the housing of the device 10'.

It should be appreciated that the configuration of the contemplated system, such as that shown in connection with the devices 10 and 10', may take a variety of forms. Moreover, the presently described embodiments do not necessarily require all components of the device to be housed on the same physical structure.

For example, a system may be implemented wherein selected components are housed on the marking device and other components are housed in a cartridge, or base station. In particular, a pen may include a marking tip and an ink reservoir. A base station may have housed thereon the radiation source as well as the power source. In such a system, a user could insert the pen in an aperture or slot of the base station such that the radiation source could excite the ink in reservoir. As noted above, so long as the radiation source is optically coupled to the ink, a radiation source need not be within the reservoir. The system could also be configured such that the radiation emitted by the radiation source does not escape the system to be undesirably viewed by observers. The pen could simply be removed from the cartridge at a time when the user desires to write on transient document media. Upon completion of the task, or at a time when the ink within the pen reaches an unexcited state, the pen may be placed back in the cartridge for charging.

Figure 3:
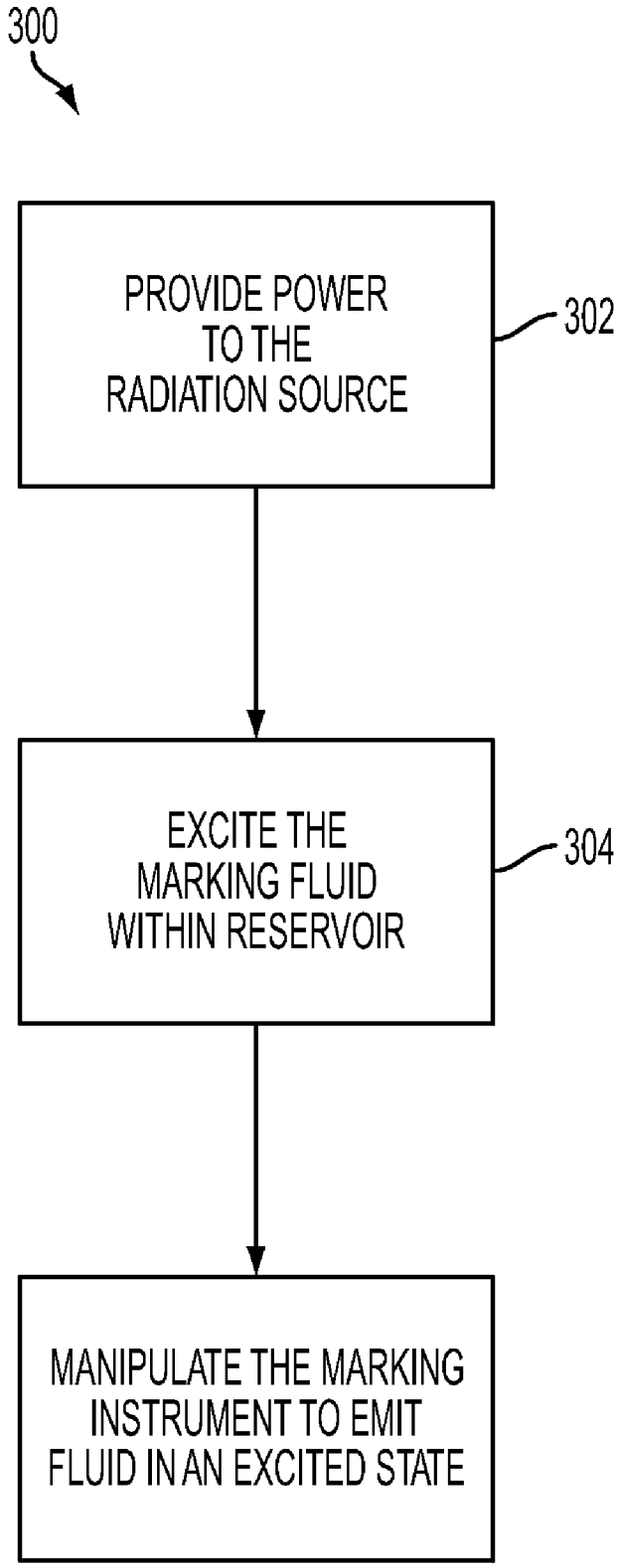

As will be understood, the configuration of an assembly according to the presently described embodiments may take a variety of forms. However, it should be understood that a method according to the presently described embodiments may be consistent, notwithstanding the precise physical configuration of the device or system. For example, with reference now to FIG. 3, a method 300 is illustrated. In the method 300, power is provided to a radiation source (at 302). Upon provision of power, the radiation source is activated to excite the marking fluid within the reservoir such that the marking fluid becomes active in the visible light range (at 304). The pen can then be manipulated so as to emit fluid from the marking tip in an excited state on to transient document media. This method can be crafted using a variety of different structures and still fall within the scope of the presently described embodiments.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A marking instrument comprising:

a elongated housing having a marking tip disposed at a first end;

a reservoir defined within the housing, the reservoir having marking fluid disposed therein, the making fluid comprising active components that are excitable upon exposure to selected wavelengths of radiation and maintain an excited state after the exposure;

an ultraviolet radiation source supported in the reservoir and proximate to the first end of the housing; and, a power source positioned within the housing and operative to provide power to the ultraviolet radiation source.

2. The marking instrument as set forth in claim 1 wherein the marking tip comprises a roller ball.

3. The marking instrument as set forth in claim 1 wherein the reservoir is proximate the first end.

4. The marking instrument as set forth in claim 1 wherein the ultraviolet radiation source is an ultraviolet light emitting diode.

5. The marking instrument as set forth in claim 1 wherein the ultraviolet radiation source comprises a lens operative to focus ultraviolet radiation on the marking tip.

6. The marking instrument as set forth in claim 1 wherein the marking fluid comprises ink.

7. The marking instrument as set forth in claim 6 wherein the ink comprises a spiropyran substance.

8. The marking instrument as set forth in claim 1 wherein the power source is a battery.

9. The marking instrument as set forth in claim 1 further comprising a switching element operative to selectively control emission of ultraviolet radiation from the ultraviolet radiation source.

10. A marking instrument comprising:

a housing having a marking tip disposed at a first end;

a reservoir defined within the housing, the reservoir having marking fluid disposed therein, the marking fluid comprising active components that are excitable upon exposure to selected wavelengths of radiation and maintain an excited state after the exposure;

a radiation source operative to selectively emit radiation and to focus the emitted radiation through the marking fluid near the marking tip; and, a power source operative to selectively provide power to the radiation source.

11. The marking instrument as set forth in claim 10 wherein the marking tip comprises a roller ball.

12. The marking instrument as set forth in claim 10 wherein the radiation source is an ultraviolet (UV) light emitting diode (LED).

13. The marking instrument as set forth in claim 10 wherein the marking fluid comprises ink.

14. The marking instrument as set forth in claim 13 wherein the ink comprises a spiropyran substance.

15. The marking instrument as set forth in claim 10 further comprising a switching element operative to control the selective emission of radiation from the radiation source.

16. A method for using a marking instrument in a transient document media system, the marking instrument including a reservoir having a marking fluid exposed therein and a marking tip disposed at an end thereof, a radiation source being positioned to emit radiation into the reservoir, the method comprising:

providing power to the radiation source;

exciting the marking fluid in the reservoir by the radiation source such that the marking fluid becomes active in the visible light range to achieve a readable state and maintains the readable state after the exciting; and, manipulating a marking instrument such that the excited marking fluid exits the reservoir through the marking tip.

17. The method as set forth in claim 16 wherein the radiation source is an ultraviolet radiation source.

18. The method as set forth in claim 16 wherein the radiation source is housed within the reservoir.

* * * * *